US008733453B2

(12) United States Patent
Guerrero et al.

(10) Patent No.: US 8,733,453 B2
(45) Date of Patent: May 27, 2014

(54) EXPANDABLE STRUCTURE FOR DEPLOYMENT IN A WELL

(75) Inventors: Julio C. Guerrero, Cambridge, MA (US); Logan Munro, New York, NY (US); Nathan Wicks, Somerville, MA (US); Agathe Robisson, Cambridge, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 526 days.

(21) Appl. No.: 12/713,758

(22) Filed: Feb. 26, 2010

(65) Prior Publication Data

US 2010/0243274 A1 Sep. 30, 2010

Related U.S. Application Data

(63) Continuation-in-part of application No. 12/034,191, filed on Feb. 20, 2008, now Pat. No. 7,896,088, which is a continuation-in-part of application No. 11/962,256, filed on Dec. 21, 2007.

(51) Int. Cl.
*E21B 23/00* (2006.01)

(52) U.S. Cl.
USPC ..... 166/380; 166/207

(58) Field of Classification Search
USPC ..... 166/380, 384, 207
See application file for complete search history.

(56) References Cited

U.S. PATENT DOCUMENTS

| | | | |
|---|---|---|---|
| 366,365 | A | 7/1887 | Averberg |
| 3,066,637 | A | 12/1962 | Akutowicz |
| 3,575,238 | A | 4/1971 | Shillander |
| 3,606,924 | A | 9/1971 | Malone |
| 3,623,566 | A | 11/1971 | Orloff |
| 3,982,248 | A | 9/1976 | Archer |
| 4,105,215 | A | 8/1978 | Rathburn |
| 4,222,577 | A | 9/1980 | Giffin |

(Continued)

FOREIGN PATENT DOCUMENTS

| | | | |
|---|---|---|---|
| EP | 0118619 | A1 | 9/1984 |
| EP | 0010601 | B1 | 12/1986 |

(Continued)

OTHER PUBLICATIONS

Abou, B., D Bonn and J. Meunier, "Nonlinear Rheology of Laponite Suspensions Under an External Drive" J. Rheol. 47, 2003, pp. 979-988.

(Continued)

*Primary Examiner* — William P Neuder
(74) *Attorney, Agent, or Firm* — Michael Flynn; Timothy Curington; Robin Nava

(57) ABSTRACT

An expandable structure for passive deployment in a well. The structure may be locked in a position determined by the inner dimensions of the well in which it is deployed. Practical uses for the structure may include production tubing or a host of other devices for affixing downhole with a final diameter as determined by the inner diameter of the well. Additionally, the structure may be configured for advancement to a targeted well location while in a collapsed state. Thus, upon deployment, subsequent structures may be advanced through the expanded/deployed structure. As such, affixed structures may be deployed downhole in both top-down and bottom-up fashions without concern over a prior deployed structure obstructing subsequent structure deployment downhole thereof.

30 Claims, 5 Drawing Sheets

(56) References Cited

U.S. PATENT DOCUMENTS

| | | | | |
|---|---|---|---|---|
| 4,345,658 | A | 8/1982 | Danel et al. | |
| 4,424,861 | A | 1/1984 | Carter, Jr. et al. | |
| 4,787,302 | A | 11/1988 | Waltman et al. | |
| 4,942,700 | A | 7/1990 | Hoberman | |
| 5,005,658 | A | 4/1991 | Bares et al. | |
| 5,024,031 | A | 6/1991 | Hoberman | |
| 5,038,532 | A | 8/1991 | Shahinpoor | |
| 5,069,572 | A | 12/1991 | Niksic | |
| 5,261,488 | A | 11/1993 | Gullet et al. | |
| 5,448,567 | A | 9/1995 | Dighe et al. | |
| 5,448,867 | A | 9/1995 | Wilson | |
| 5,788,002 | A | 8/1998 | Richter | |
| 6,082,056 | A | 7/2000 | Hoberman | |
| 6,219,974 | B1 | 4/2001 | Hoberman | |
| 6,248,096 | B1 | 6/2001 | Dwork et al. | |
| 6,299,173 | B1 | 10/2001 | Lai | |
| 6,379,071 | B1 | 4/2002 | Sorvino | |
| 6,512,345 | B2 | 1/2003 | Borenstein et al. | |
| 6,513,601 | B1 | 2/2003 | Gunnarsson et al. | |
| 6,601,652 | B1 | 8/2003 | Moore et al. | |
| 6,910,533 | B2 | 6/2005 | Guerrero | |
| 7,044,245 | B2 | 5/2006 | Anhalt et al. | |
| 7,059,410 | B2 | 6/2006 | Bousche et al. | |
| 7,137,993 | B2 * | 11/2006 | Acosta et al. | 623/1.11 |
| 7,156,192 | B2 | 1/2007 | Guerrero et al. | |
| 7,235,046 | B2 | 6/2007 | Anhalt et al. | |
| 7,334,642 | B2 | 2/2008 | Doering et al. | |
| 7,401,665 | B2 | 7/2008 | Guerrero et al. | |
| 7,704,275 | B2 * | 4/2010 | Schmid et al. | 623/1.16 |
| 2002/0042314 | A1 | 4/2002 | Mimura | |
| 2002/0107562 | A1 * | 8/2002 | Hart et al. | 623/1.15 |
| 2004/0080563 | A1 | 4/2004 | Leemhuis | |
| 2004/0097876 | A1 | 5/2004 | Shkolnik | |
| 2004/0220012 | A1 | 11/2004 | Siman-tov | |
| 2005/0016302 | A1 | 1/2005 | Simpson | |
| 2005/0090893 | A1 | 4/2005 | Kavteladze et al. | |
| 2007/0089886 | A1 * | 4/2007 | Orban et al. | 166/382 |

FOREIGN PATENT DOCUMENTS

| | | | |
|---|---|---|---|
| EP | 0101805 | B1 | 12/1986 |
| EP | 00106016 | B1 | 12/1986 |
| EP | 0443408 | B1 | 2/1994 |
| EP | 0455850 | B1 | 5/1995 |
| EP | 1005884 | A2 | 6/2000 |
| EP | 1072295 | A2 | 1/2001 |
| EP | 1073825 | B1 | 2/2001 |
| EP | 1219754 | A1 | 7/2002 |
| EP | 1350917 | | 10/2003 |
| GB | 2368082 | A | 4/2002 |
| GB | 2371066 | A | 7/2002 |
| GB | 2397084 | A | 7/2004 |
| WO | 2004000137 | B1 | 12/1986 |
| WO | 9727396 | A1 | 7/1997 |
| WO | 0263111 | A1 | 8/2002 |
| WO | 03054318 | A2 | 7/2003 |
| WO | 2005008023 | A1 | 1/2005 |
| WO | 2005031115 | A1 | 4/2005 |

OTHER PUBLICATIONS

"The Apple Snail Website" , Jul. 27, 2006, http://www.applesnail.net/content/species/asolene_asolene_spixi.htm.

Ashmore, J., C. Del Pinto, and T. Mullin, "Cavitation in a Lubrication Flow Between a Moving Sphere and a Boundary." Physical Review Letters 94, 2005, pp. 124501-1 to 124501-4.

Balmforth, N.J., and R.V. Craster, "A Consistent Thin-Layer Theory for Bingham Plastics." J. Non-Newtonian Fluid Mech. 84, 1999, pp. 65-81.

Cook, G. "MIT Scientists Copy the Snail's Pace." The Boston Globe, Jul. 3, 2003: A1.

Denny, M. "The Role of Gastropod Pedal Mucus in Locomotion" Nature 285, May 1980, pp. 160-161.

Denny, M.W. A Quantitative Model for the Adhesive Locomotion of the Terrestrial Slug, Ariolimax Columbianus, J. Exp. Biol, 91, 1981, pp. 195-217.

Hancock, G.J. "The Self-Propulsion of Microscopio Organisms Through Liquids" Proceeding of the Royal Society of London, Series A., Mathematical and Physical Sciences 217, 1953, pp. 96-121.

Itoh, et al. "Film Structure Soft Actuator for Biominetics of Snail's Gastropod Locomotion" 6th International Conference Control, Automation, Robotics and Vision ICARCV'2000, 2000.

Lissman, H.W. "The Mechanism of Locomotion in Gastropod Molluscs" The Journal of Experimental Biology 21, 1945, pp. 58-69.

Lissman, H.W. "The Mechanism of Locomotion in Gastropod Molluscs" The Journal of Experimental Biology 22, 1946, pp. 37-50.

Mahadevan et al. "Biominetic Ratcheting Motion of a Soft, Slender, Sessile Gel" PNAS 101 (1), 2004, pp. 23-26.

Moffett, S. "Locomotion in the Primitive Pulmonate Snail Melampus Bidentatus: Foot Structure and Function" The Biological Bulletin 157, Oct. 1979, pp. 306-319.

Reynalds, O. "On the Theory of Lubrication and its Application to Mr. Beauchamp Tower's Experiments, Including and Experimental Determination of the Viscosity of Olive Oil" Philos, Trans. R. Soc. London, Ser. A 177, 1886, pp. 157-235.

Skotheim, J.M. et al. "Soft Lubrication" Physical Review Letters vol. 92, No. 24, Jun. 2004, pp. 245509-1 to 245509-4.

Taylor, G. "Analysis of the Swimming of Miscroscopic Organism" Processings of the Royal Society of London, Series A, Mathematical and Physical Sciences 209, 1951, pp. 447-461.

Vles, F. "Zoologie.—Su les ondes pedieuses des Mollusques reptateurs" C.R. Acad. Sci., Paris 145, 1907, pp. 276-278.

Willenbacher, N. "Unsual Thixotropic Properties of Aqueous Dispersions of Laponite RD" Journal of Colloid and Interface Science 182, 1996, pp. 501-510.

* cited by examiner

EXPANDABLE STRUCTURE FOR DEPLOYMENT IN A WELL

CROSS REFERENCE TO RELATED APPLICATION(S)

This Patent Document is a continuation-in-part claiming priority under 35 U.S.C. §120 to U.S. application Ser. No. 12/034,191 entitled Wellsite Systems Utilizing Deployable Structure, filed on Feb. 20, 2008 now U.S. Pat. No. 7,896,088, and which is a continuation-in-part under 35 U.S.C. §120 to U.S. application Ser. No. 11/962,256 entitled System and Methods for Actuating Reversible Expandable Structures, filed on Dec. 21, 2007, both of which are incorporated herein by reference in their entireties.

FIELD

Embodiments described relate to expandable structures for use at a well site. In particular, embodiments detailed herein are focused on deployment of expandable structures within a well. Each structure is configured with an outer diameter defined by its interfacing of the wall of the well. Further, each structure may be configured to also allow for the sequential top down deployment of further structures downhole thereof, without a requirement that further uphole structures be first removed.

BACKGROUND

Exploring, drilling and completing hydrocarbon and other wells are generally complicated and ultimately very expensive endeavors. In recognition of the potentially enormous expenses involved, added emphasis is regularly placed on streamlining the processes of drilling, completions, and even intervening well applications which require some degree of access. That is, by streamlining the amount of time and equipment employed over the course of various drilling, completions and interventions, a dramatic effect on the overall amount of expenses consumed by a given well may be realized.

One manner by which streamlining of well applications is often pursued is in the area of interventions. So, for example, where a wellbore operation such as a well treatment application is to be run, mobile coiled tubing equipment may be employed. That is, rather than reconstruct a large scale rig over the well to support a subsequent treatment application, a relatively mobile coiled tubing truck and injector may be delivered to the well site. Thus, coiled tubing from a reel at the truck may be run through the injector and advanced into the well to a treatment location therein.

The 'rig-less' nature of coiled tubing as described above, may save a degree of time and equipment expenses in avoiding a complete up-rigging of tools. Nevertheless, a fair amount of equipment is located at the well site, such as the noted injector and pressure control equipment (often referred to as a blow-out preventor (BOP) stack). Furthermore, a multi-tool toolstring of variable diameter is located at the end of the coiled tubing and must be run through the BOP, tool by tool, in order to be made available for advancement to the treatment location.

Unfortunately, a whole host of well, tool and downhole device diameter issues present challenges to completions and interventional applications, streamlined or otherwise. With specific reference to a coiled tubing treatment as noted above, the variable diameter toolstring may require as much as two hours per tool to load through the BOP. This is due to each tool being individually loaded and coupled to the next tool and/or coiled tubing end, so as to maintain controlled pressurization. All in all, depending on the length of the toolstring and number of tools involved, it may take about 15-30 hours to completely load the toolstring. At an average cost of about $50,000 per hour, simply equipping the site for the treatment application may become extremely expensive.

Other forms of completions or interventional streamlining may also face certain diameter-related challenges or limitations even after downhole access is successfully achieved. One such limitation, relates to the general requirement that downhole device fixtures be deployed in a bottom-up fashion. So, for example, where multiple packers are to be deployed and left in a well for zonal isolation, the downhole packer is first deployed, followed by the deployment of a more uphole packer. That is, unlike a spot treatment, the deployment of a fixture such as the initially deployed packer would present an obstacle to later deployment of a packer further downhole. Thus, where a fixture is to be deployed, it is deployed after all further downhole access is completed.

Unfortunately, requiring access take place in a particular sequential order, such as the above-noted bottom-up access, places a significant limitation on operational flexibility. For example, in the noted case of packer deployment, the placement of the first packer serves as an obstruction preventing delivery of another packer or tool downhole of the initial packer. Thus, in order to access regions of the well below a fixed packer, a packer removal application must first be run. Similar scenarios hold true for a variety of downhole fixtures. For example, in the area of completions, once production tubing is firmly affixed downhole, the possibility of extending the depth of production tubing is hampered by the fixed presence of the production tubing already in place.

Any number of additional well, tool, and device diameter-related issues arise on a regular basis at the oilfield. Indeed, even the presumed diameter of the well itself generally varies by as much as a couple of inches. All in all, operators are faced with diameter-related challenges from the time deployment equipment outside of the well is utilized until post-completion access is sought and everywhere in between. As a result, significant practical limitations exist when attempting to employ flexibility or streamline such applications.

SUMMARY

An expandable structure is disclosed for deployment in a well. The structure may include a plurality of linked modules. Together, these modules may dynamically define an outer diameter of the structure based on an inner diameter of the well upon the deployment.

The expandable structure may be passively deployed. Additionally, at least one of the modules may include a locking mechanism. The locking mechanism may serve to immobilize a first member of the module at a pre-determined angular position relative to a second member of the module, thereby maintaining or locking the deployment in place.

DETAILED DESCRIPTION

Embodiments are described with reference to certain techniques, equipment and tools for downhole use. In particular, focus is drawn to methods and devices which are employed at an open-hole well in the form of fixed production tubing and coiled tubing delivery equipment. However, a host of alternate forms of downhole devices and delivery techniques may be employed which take advantage of embodiments of closed loop kinematics mechanisms as detailed herein. Such mechanisms, referred to herein as expandable structures, may also be employed in constructing expandable packers, restrictions, support structure and a host of other oilfield device and deployment uses. Regardless, when deployed downhole in a well, the structure includes linked modules configured to act together in dynamically defining an outer diameter thereof based on the diameter of the well.

Figure 1:
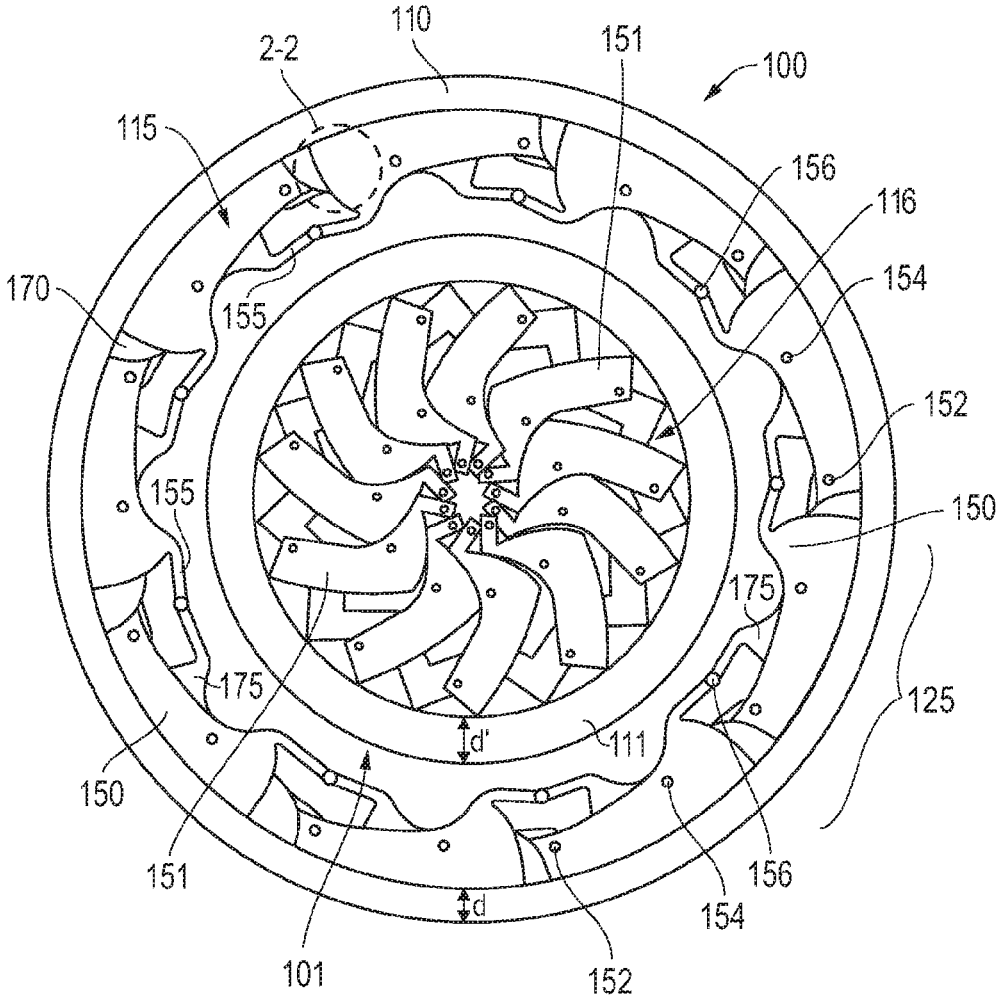
FIG. 1 is a front view of an embodiment of a given expandable structure in an expanded state accommodating another expandable structure in a collapsed state.

Referring now to FIG. 1, embodiments of two expandable structures 100, 101 are depicted. As detailed further herein, the structures 100, 101 are configured to serve as production tubing segments in an open-hole well 380 (see FIG. 3). However, as noted above, such structures 100, 101 may be employed for a host of alternative downhole uses. Additionally, in the embodiment shown, the collapsed structure 101 may be small enough in outer diameter to mobily fit through the inner diameter of the structure 100 in its expanded state. Indeed, in the embodiment shown, the structures 100, 101 are of the same off-the-shelf specifications in terms of size, number of modules 125, etc. as described below. The difference being that one structure 100 is in an expanded state, whereas the other 101 is in the collapsed state.

The difference between a structure's expanded and collapsed state is referred to as its expansion ratio. In the embodiments of FIG. 1, the main body of the structures 100, 101 have an expansion ratio that is about 200%-300%. In other words, the fully expanded structure 100 is about twice the size of the collapsed structure 101, in terms of diameter. Indeed, most preferred embodiments for well usage will have an expansion ratio of up to about 300%. However, depending on the circumstances, anywhere from about 5% to about 500% may be practical.

Continuing with reference to the expanded structure 100 of FIG. 1, it is made up of modules 125 which are linked together circumferentially. In turn, each module 125 includes forward 150 and rearward 175 members which are pivotally jointed relative to one another through a central pivot 154. With this in mind, an expansion ratio as described above may be determined. That is, an expansion ratio for a structure of jointed or linked members may roughly be determined by the equation $m/n\pi$, where m is the number of modules 125 and n is the number of pivots in the body of the members 150, 175. Thus, in this case, there are about 9 modules 125 and a single pivot through each member body resulting in an approximate expansion ratio of about 9/(1)(3.14), or 286% (i.e. the 200%-300% noted above).

Of course, each module 125 is also linked to each adjacent module 125 through pivots 152, 156 at either end thereof. For example, an inner arm pivot 156 connects the arm 155 each forward member 150 to the arm 155 of each rearward member 175. Similarly adjacent members 150, 175 are linked through an outer abutting pivot 152. With reference to the collapsed structure 101, these same features may be seen upon inspection of members 151 which are oriented in the collapsed position (e.g. revealing internal pivots originating at a truly internal position in advance of structure expansion).

Each module 125 is equipped with a locking mechanism 170 mounted to each rearward member 175. As detailed below, this mechanism 170 serves as a locking interface between the members 150, 175 so as to ensure maintenance of the expanded state of the structure 100 following synchronized rotation of the members 150, 175 from a collapsed state (such as that of the collapsed structure 101). Additionally, in certain embodiments, each structure 100, 101 may be encircled by a compliant material layer 110, 111 (e.g. about its main body 115, 116).

As detailed below, the compliant material layers 110, 111 may be of elastomers or other materials suitable for downhole use, particularly for interfacing and/or sealing engagement with a well wall 382 (see FIGS. 3-5). Further, each layer 110, 111 may in essence be multilayered in the form of material multi-wrapped about the structure 100, 101 that may unwind or unravel as a structure 101 moves from a collapsed to an expanded state (see FIG. 5). Thus, in the embodiment of FIG. 1, the thickness (d') of the layer 111 about the collapsed structure 101 is greater than the thickness (d) of the layer 110 about the expanded structure. This is due to the noted unraveling, as a layer 110, 111 of a smaller collapsed structure 101 is forced to encompass a larger structure 100. Stated another way, the overall perimeter is greater for the expanded structure 100, and thus, a smaller amount of layering is present in its outer layer 110.

Figure 5:
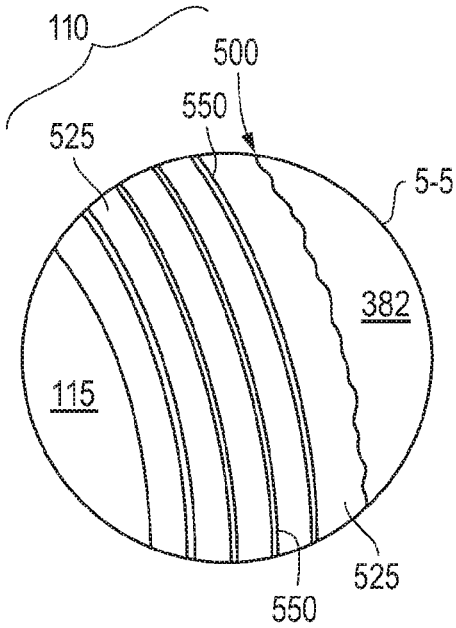
FIG. 5 is an enlarged view of a portion of the fixed production tubing segment taken from 5-5 of FIG. 4.

In a related alternate embodiment, the outer layers 110, 111 of the structures 100, 101 may be made up of a unitary stretchable sealing material as opposed to the multi-wrapped configuration as depicted in FIG. 5. Again, the thickness of the material would become thinner as the structures 100, 101 expand. However, in circumstances where the degree of expansion allows for such cohesive and unitary layers 110, 111, such embodiments may be quite practical.

Figure 2A:
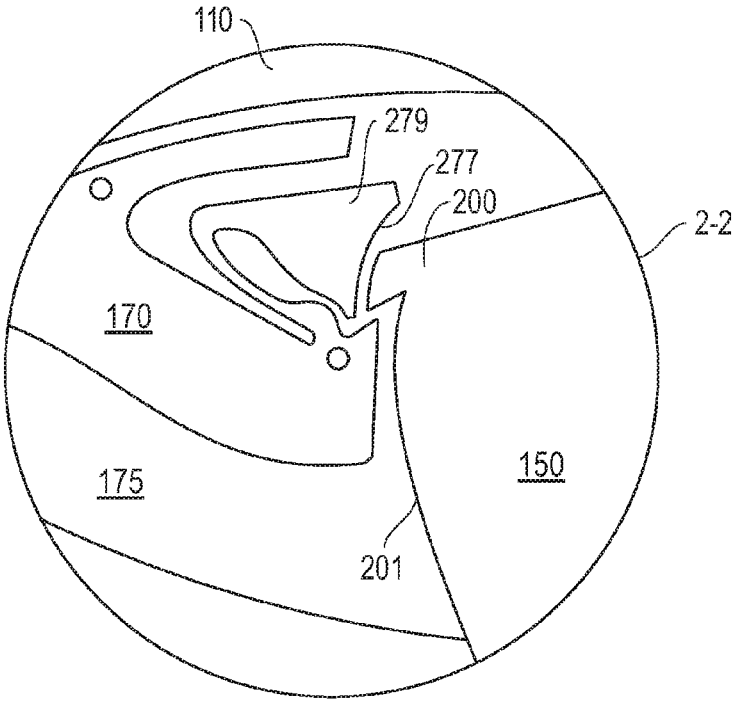
FIG. 2A is an enlarged view of an embodiment of a locking mechanism taken from 2-2 of FIG. 1 and configured for immobilizing module members of the given expandable structure relative to one another.
Figure 2B:
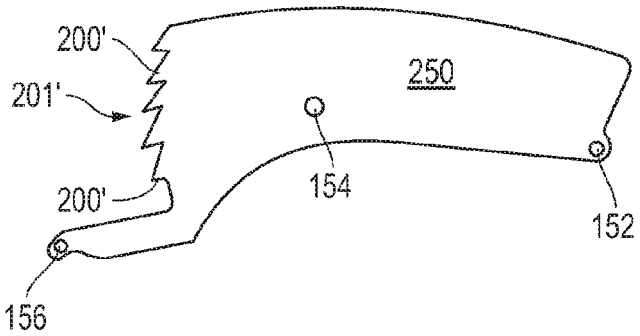
FIG. 2B is an alternate embodiment of a module member with multiple locking teeth for engaging the locking mechanism at multiple locations.

Referring now to FIGS. 2A and 2B, the above-noted locking mechanism 170 is described in greater detail. Namely, as the structure 100 of FIG. 1 is expanded and the forward members 150 pivoted about the central pivot 154 toward alignment with the rearward members 175, the locking mechanism 170 may be utilized to lock the structure 100 in an expanded state. Indeed, a minimum state of expansion is ensured as a tooth 200 of the face 201 of the forward member 150 moves past a latch or pawl 279. While most of the body of the locking mechanism 170 may be immobily secured to the rearward member 175 depicted, the pawl 279 may serve as a movable biasing component of the mechanism 170. Further, a surface 277 may be provided to receive the tooth 200 and help to transition it into engagement as it passes the pawl 279.

As noted above, and with added reference to FIG. 1, the described locking mechanism 170 of FIG. 2A helps to ensure a minimum state of expansion is maintained upon deployment of the structure 100. That is, once the tooth 200 is engaged with the pawl 279 as described, further expansion may be possible. However, without intentional measures disengaging the tooth 200, retraction of the structure 100 is not.

With the above concept of further expansion in mind, FIG. 2B depicts an alternate embodiment of the forward member 250. In this embodiment, the member 250 is equipped with a variety of teeth 200' at different positions along its face 201'. Thus, the face 201' may be thought of as a ratchet surface. In such an embodiment, a tooth 200' nearest the inner arm pivot 156 may first pass the pawl 279 establishing an initial minimum state of expansion. However, where well diameter and morphology allow for further expansion of the structure 100, teeth 200' further from the arm pivot 156 may sequentially pass the pawl 279 until a maximum level of expansion is achieved (e.g. note interfacing of the well wall 382 and structure 100 at FIGS. 3-5). Thus, as each subsequent tooth 200' passes the pawl 279, a new and greater minimum state of expansion is ensured.

Figure 3:
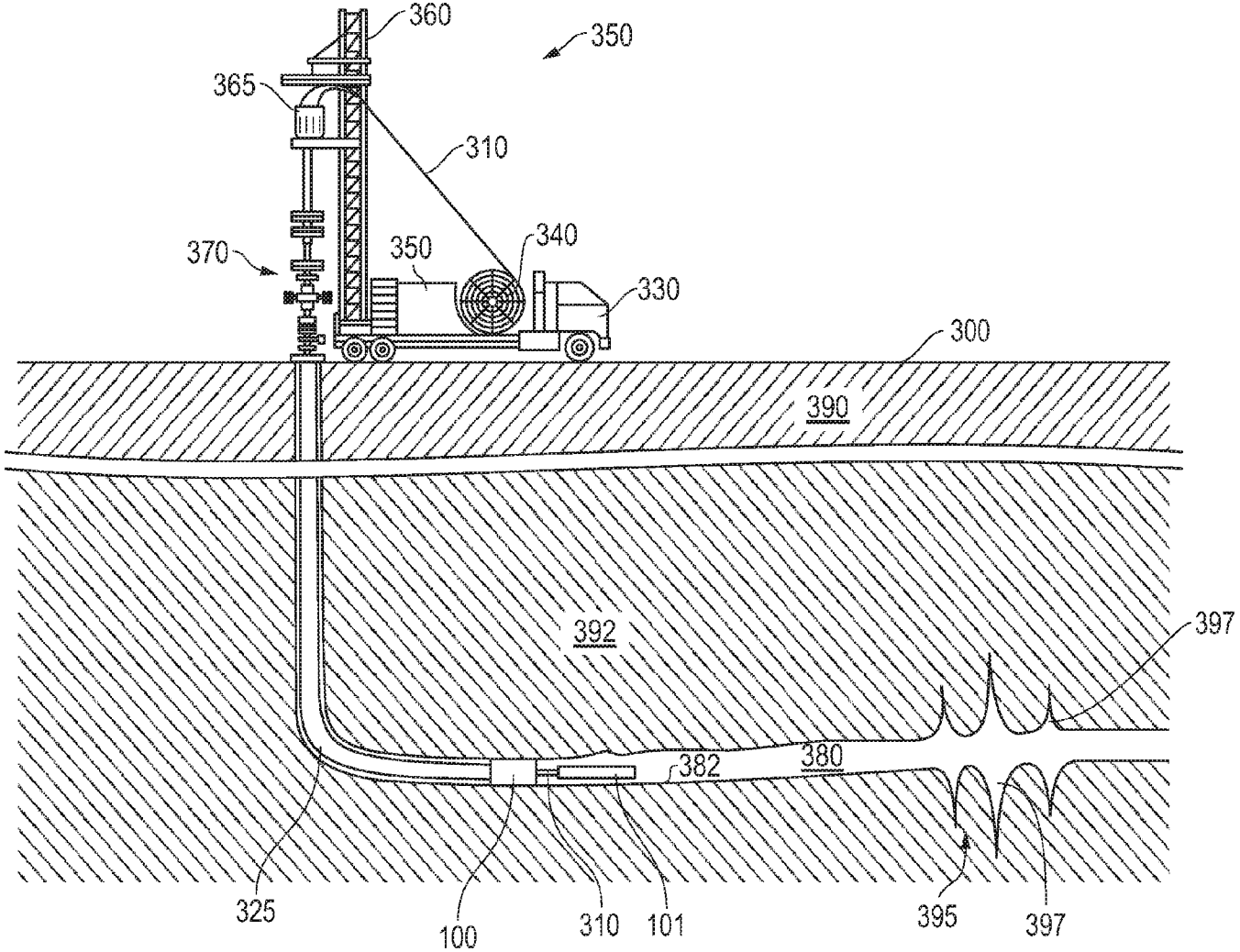
FIG. 3 is an overview of an oilfield accommodating an open-hole well with the expandable structures of FIG. 1 therein as production tubing segments.

Referring now to FIG. 3, an overview of an oilfield 300 is depicted at which an open-hole well 380 is accommodated which makes practical use of the expandable structures 100, 101 of FIG. 1. That is, in the embodiment shown, the structures 100, 101 are configured as production tubing segments as part of a larger overall completion assembly. Indeed, as shown in FIG. 3, production tubing 325 is run from surface, through various formation layers 390, 392, terminating adjacent a production region 395. Of course, in other embodiments such structures 100, 101 may be employed as patches or seals in cased wells, for deployment of downhole sensors at a well wall, or a host of other uses.

Continuing with reference to FIG. 3, the expanded structure 100 is utilized as a production tubing segment which affixes the terminal end of the tubing 325 in position at the wall 382 of the open-hole well 380. As described further below, the structure 100 is particularly well suited for such passive deployment (e.g. with its outer expansive limit defined by the well 380). Further, in spite of the fixed nature of the expanded structure 100, a collapsed expandable structure 101 may be subsequently deployed at a location downhole of the expanded structure 100. Indeed, this may be achieved without requirement of collapse or removal of the expanded structure 100.

Continuing with reference to FIG. 3, the production tubing 325 is affixed within a deviated portion of the well 380 some distance from the noted production region 395. Therefore, in the depicted example scenario, the production tubing 325 may be extended to a location closer to the production region 395 by way of additional structures 101 such as that depicted. As also noted, this means that the effective production tubing 325 may be built or extended from top-down, as opposed to bottom-up. Thus, the terminal end of the production tubing 325 may be changed over time, regardless of where it was initially located, and without the requirement that downhole affixing structures first be collapsed or removed. As a result, countless application hours and dollars may be saved. Furthermore, as a practical matter, applications such as the moving and/or extending the reach of production tubing 325 may be rendered truly viable from a cost standpoint.

Given that the depicted collapsed structure 101 is to be delivered to a deviated portion of the well 380, surface equipment 350 is provided which includes coiled tubing 310, particularly adept at such delivery. Namely, a coiled tubing truck 330 is provided which accommodates a conventional coiled tubing reel 340 and control unit 350 for directing the operation. A mobile tower 360 is also provided for support of an injector 365 which may be employed to forcibly drive the coiled tubing 310 from the reel 340 and through the well 380. Further, in reaching the well 380, the coiled tubing 310 and collapsed structure 101 are advanced through valving and pressure control equipment 370 often referred to as a 'Christmas Tree' or BOP (blow-out-preventor stack).

In certain embodiments, expandable structure concepts, such as those detailed herein, may be employed in conjunction with the injector 365, BOP 370 and other equipment to aid in the driving of the coiled tubing 310 through the well 380. Indeed, embodiments of achieving an inchworm-like conveyance through the inner diameter of expandable/collapsible structures in series are detailed throughout co-pending U.S. application Ser. No. 12/034,191 (Wellsite Systems Utilizing Deployable Structure), incorporated herein by reference in its entirety. With BOP pressure control requirements in mind, employing such structures and techniques may save countless hours and expenses in achieving well access. For example, consider the varying diameters involved in driving the coiled tubing 310, production tubing structures 100, 101, or even a multi-tool toolstring (not depicted), into the well 380. An inchworm-like conveyance with expandable/collapsible structures may be utilized to maintain pressure control while simultaneously avoiding the need to re-set pressure valving and equipment with each encountering of a new diameter feature.

Continuing with the noted example scenario of FIG. 3, the effort may be to extend production tubing 325 closer and closer to perforations 397 of the production region 395. Therefore, the coiled tubing 310 may be directed by the control unit 350 to deliver the collapsed structure 101 through the expanded structure 100 (see also FIG. 1). As also indicated above, this may be achieved without significant impact on the affixed expanded structure 100. Additionally, as also noted above, upon clearing the location of the expanded structure 100, the collapsed structure 101 may be deployed adjacent the expanded structure 100, thereby extending the reach of the production tubing 325.

Again, deployment of the structures 100, 101 from the collapsed state to an expanded state may be achieved through a variety of techniques as detailed throughout co-pending U.S. application Ser. Nos. 12/034,191 (Wellsite Systems Utilizing Deployable Structure) and 11/962,256 (System and Methods for Actuating Reversible Expandable Structures). As detailed in these co-pending applications, such techniques may include the use of a rotary actuator, lever-type actuator, Peaucellier-Lipkin linkages, and others.

In one embodiment, the collapsed structure 101 may be delivered and deployed at a location substantially downhole of the depicted expanded structure 100, For example, a subsequent bottom-up expansion of the reach of the production tubing 325 may be sought. Of course, such delivery of the collapsed structure 101 may also be used to line or close off other regions of the open-hole well 380, perhaps even the production region 395 itself. Regardless, both top-down and bottom-up construction are rendered practical options for the operator along with any other isolated delivery of a structure 101 downhole of the initial expanded structure 100.

Figure 4:
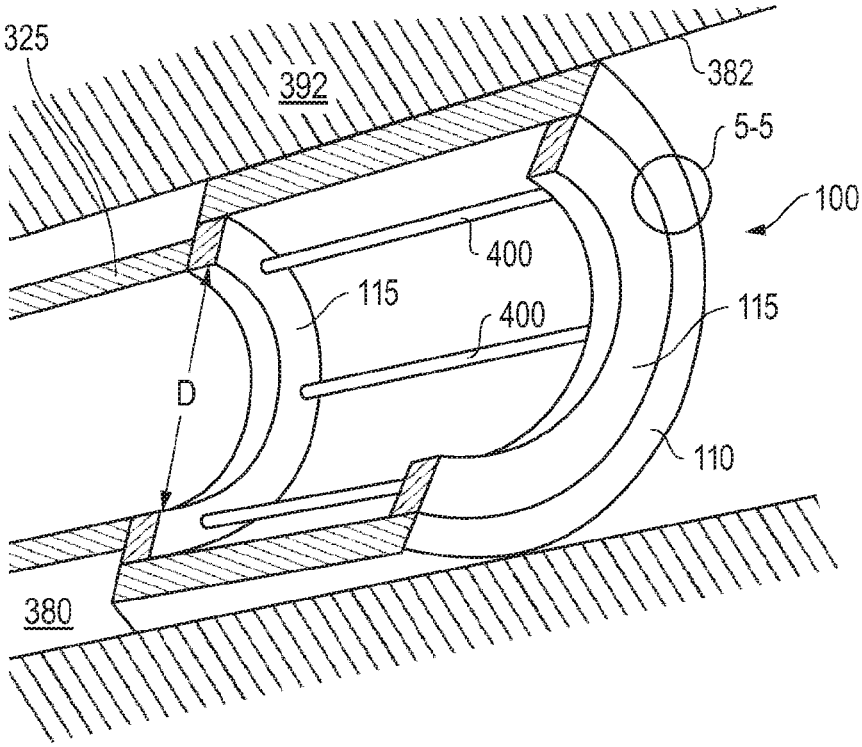
FIG. 4 is a side cross sectional view of the given expandable structure of FIG. 3 serving as a fixed production tubing segment in the open-hole well.

Referring now to FIG. 4, a side cross sectional view of the expanded structure 100 of FIG. 3 is shown. Again, the structure 100 is employed as an affixed extension of production tubing 325. Additionally, in this view, the structure 100 is shown in partially schematic form with its main body 115 depicted as a solid arch-like monolith. In this depiction, the firmly expanded main body 115 may translate force through the compliant material layer 110 and to the wall 382 of the open-hole well 380. Indeed, the arch-like structural support as transitioned through the material layer 110 may be beneficial in achieving secure placement of the structure 100. This may be particularly the case in the circumstance of an open-hole well 380 which is prone to variability in diameter, morphology, wall hardness, etc.

The deployed structure 100 of FIG. 4 reveals a diameter (D) that is adequate for accommodating the passage there-through of a structure 101 in its collapsed state as depicted in FIG. 3 (see also FIG. 1). Additionally, the cross-sectional view also reveals that the structure 100 may be made up of multiple main bodies 115 encased by the compliant material layer 110. In the embodiment shown, there are two main bodies 115, one at each end of the structure 100, with support bars 400 mounted there-between. In one embodiment, these bars 400 may also serve to aid in driving actuation of the main bodies 115 and the structure 100 into the expanded state as depicted. This expanded state may be passively achieved as noted, with the outer diameter of the structure 100 determined by the inner diameter of the well 380. Additionally, in alternate embodiments, alternate main body 115 positioning and numbers may be employed. Indeed, in one embodiment, a series of main bodies 115 occupying substantially the entire underside of the compliant material layer 110 may be utilized.

Referring now to FIG. 5, an enlarged view of a portion of the expanded structure 100 is shown taken from 5-5 of FIG. 4. In this view, the interface 500 of the material layer 110 and the well wall 382 may be seen. Indeed, in spite of the evident physical irregularity of the interface 500 due to the open-hole nature off the well 380, the compliant nature of the layer 110 allows for the secure transition of forces from the main body 115 for stabilization of the structure 100. In the embodiment shown, the compliant nature of the material layer 110 is provided by multiple wrappings of a conformable material 525 about the main body 115. The conformable material 525 may be made up of any of a number of polymers, rubbers, elastomers or foams suitable for forming a sealing engagement at the noted interface 500.

In addition to the conformable material 525 described above, the material layer 110 includes an anti-friction material 550 disposed at the underside of the conformable material 525. This anti-friction material 550 may be any number of materials suitable for allowing the unwrapping or unraveling of adjacent layers of conformable material 525 as the main bodies 115 move from the collapsed to expanded states as detailed hereinabove. Such anti-friction material 550 may include a thermoplastic polymer such as polyether ether ketone (PEEK) or any number of materials suitable for avoiding frictional obstacles to such unwrapping or unraveling as described.

Figure 6:
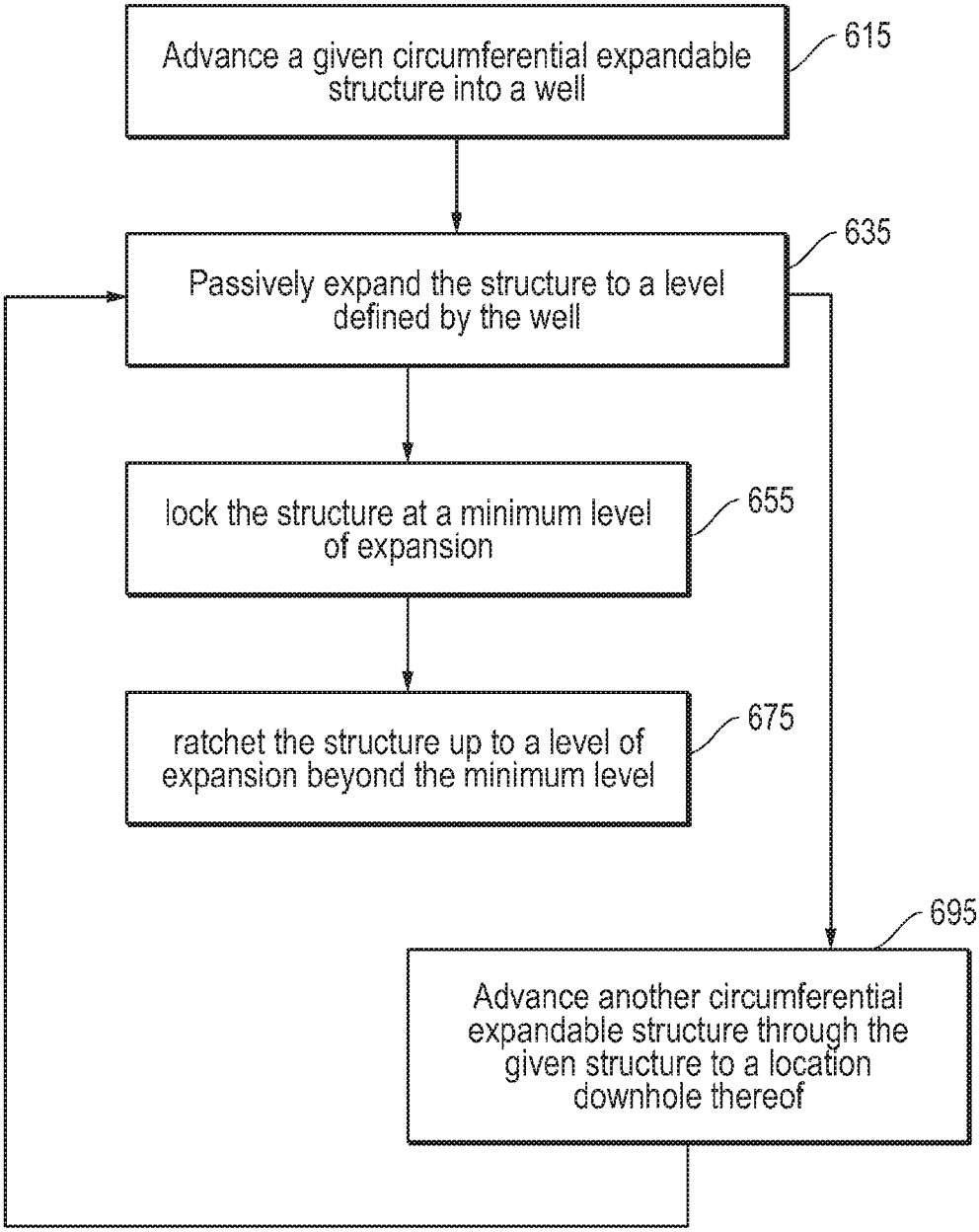
FIG. 6 is a flow-chart summarizing an embodiment of employing expandable structures in a well.

Referring now to FIG. 6, a flow-chart is provided which summarizes embodiments of employing expandable structures in a well. As indicated at 615 a given expandable structure may be advanced within a well. For example, as detailed hereinabove, the structure may be advanced in a collapsed state via coiled tubing or other suitable delivery mechanism. Additionally, as noted hereinabove, expandable structure concepts may even be employed in achieving the driving advancement of the structure and/or associated tools downhole. Thus, challenges associated with maintaining pressure control over variable diameter devices being loaded and pushed downhole may be reduced while simultaneously saving time and expense in achieving downhole access.

Once reaching a targeted location within the well, the structure may be expanded to a level as defined by the well itself. In this sense, the deployment may be referred to as a passive deployment as indicated at 635. Additionally, as indicated at 655 upon deployment, the structure may be locked at a minimum level of expansion to ensure that it does not subsequently collapse downhole. This may even be followed by additional ratcheting up expansion beyond an initial predetermined minimum level as indicated at 675. Furthermore, once expanded, deployment of the given structure may be followed by advancement of another expandable structure into and/or through the given structure as indicated at 695. From this point, the other structure may be advanced further downhole, passively expanded, or otherwise deployed in a manner similar to the given structure as indicated at 635, 655 and 675.

Embodiments described hereinabove include structures and techniques for addressing a host of oilfield diameter related challenges. These structures and techniques may be utilized to dramatically curtail the amount of time required to deploy tools and structures into a well without sacrifice to pressure control. Furthermore, as detailed herein more extensively, such structures and techniques may be utilized to overcome the requirement of deploying device fixtures solely in a bottom-up fashion. As a result, options for deploying structures such as packers, production tubing, sleeves and other devices downhole may be dramatically opened up.

Furthermore, persons skilled in the art and technology to which these embodiments pertain will appreciate that still other alterations and changes in the described structures and methods of operation may be practiced without meaningfully departing from the principle and scope of these embodiments. For example, rather than utilizing a conformable material for the compliant layer, the main bodies of the expandable structures may be outfitted with structural compliant members extending from the outer surfaces thereof. In this manner, a plurality of biased structural elements may be utilized to account for any dimensional or physical variability at the interface of the well and structure. Additionally, while depicted as relatively circular or circumferential herein, the expandable structures may be expandable to a variety of shapes, including elliptical, polygonal and other configurations. Regardless, the foregoing description should not be read as pertaining only to the precise structures described and shown in the accompanying drawings, but rather should be read as consistent with and as support for the following claims, which are to have their fullest and fairest scope.

We claim:

1. An expandable structure for deployment in a well, the structure comprising a plurality of pivotally jointed linked modules configured for dynamically defining an outer diameter of the structure based on an inner diameter of the well upon deployment, and one of a compliant material layer and a plurality of structural compliant members disposed about the plurality of linked modules to interface a wall of the well upon the deployment.

2. The expandable structure of claim 1 wherein the defining includes locking the outer diameter of the structure in place.

3. The expandable structure of claim 1 wherein the outer diameter of the structure takes on a configuration that is one of circumferential, elliptical, and polygonal.

4. The expandable structure of claim 1 wherein the deployment is in the form of one of a production tubing segment, a packer, a restriction and a downhole support structure.

5. The expandable structure of claim 1 wherein each module comprises a forward member jointed to a rearward member about a central pivot.

6. The expandable structure of claim 1 configured for transitioning between a collapsed state for mobility and an expanded state for the deployment.

7. The expandable structure of claim 6 wherein said members are configured for synchronized rotation about the central pivot for the transitioning.

8. The expandable structure of claim 6 wherein an outer diameter of the structure in the collapsed state is smaller than an inner diameter of the structure in an expanded state.

9. The expandable structure of claim 6 wherein an expansion ratio between the structure in the collapsed state and the structure in the expanded state is between about 5% and about 500%.

10. The expandable structure of claim 1 wherein said compliant material layer is of a conformable material for sealing at the interface and selected from a group consisting of a polymer, a rubber, an elastomer and foam.

11. The expandable structure of claim 1 wherein the compliant material layer is a conformable material multi-wrapped about said plurality in a collapsed state of the structure.

12. The expandable structure of claim 11 wherein the conformable material is configured for unraveling to allow an expanded state of the structure during the deployment.

13. The expandable structure of claim 12 further comprising anti-friction material at an underside of said conformable material to promote the unraveling.

14. The expandable structure of claim 13 wherein said anti-friction material is a thermoplastic polymer.

15. The expandable structure of claim 1 wherein said plurality is configured as an arch-like main body to transition force through said compliant material layer to the wall upon the deployment.

16. The expandable structure of claim 15 wherein the body is of a plurality of bodies occupying substantially an entire underside of said complaint material layer.

17. The expandable structure of claim 1 wherein said plurality of linked modules is a first plurality, the structure further comprising a second plurality of linked modules, said pluralities of linked modules defining opposite ends of the structure.

18. The expandable structure of claim 17 further comprising at least one support bar disposed between said pluralities of linked modules and coupled thereto.

19. The expandable structure of claim 18 wherein said at least one support bar is configured to aid in actuation of the deployment.

20. An expandable structure comprising:

a plurality of linked modules configured to transition the structure between a collapsed state for mobility and an expanded state for deployment in a well, wherein a module of the plurality comprises a forward member jointed to a rearward member about a central pivot and wherein the forward member of each of the modules is linked to a rearward member of an adjacent module through an outer abutting pivot and wherein an arm of each forward member of each of the modules is linked to an arm of each rearward member of an adjacent module through an inner arm pivot; and at least one locking mechanism of the module to ensure maintenance of at least a minimum state of expansion for the structure upon the deployment.

21. The expandable structure of claim 20 wherein said rearward member comprises a pawl of said locking mechanism and said forward member accommodates a tooth at a face thereof, the pawl configured for engagement of the tooth for the maintenance.

22. The expandable structure of claim 21 wherein the engagement occurs as said members rotate about the central pivot to induce the expanded state.

23. The expandable structure of claim 21 further comprising a biasing component of the first member to direct the engagement.

24. The expandable structure of claim 21 wherein the face is ratcheted with the tooth as a first tooth and further including at least one other tooth, the minimum state of expansion being an initial minimum state of expansion, a greater minimum state of expansion maintained as the pawl engages the at least one other tooth.

25. A method of deploying an expandable structure in a well, the method comprising:

advancing the structure in a collapsed state to a location in the well;

passively expanding a plurality of pivotally jointed linked modules for transitioning of the structure to an expanded state at the location, a level of expansion for the expanded state defined by the well thereat; and performing at least one wellbore operation, wherein the expandable structure enables performing the wellbore operation in a top-down operation or a bottom-up operation.

26. The method of claim 25 wherein advancing comprises inchworm advancement through a series of collapsible structures for maintaining pressure control.

27. The method of claim 25 wherein passively expanding comprises locking the structure at least a minimum level of expansion.

28. The method of claim 27 wherein passively expanding further comprises ratcheting the structure up to a level of expansion beyond the minimum level.

29. The method of claim 25 wherein the structure is a first structure, the method further comprising advancing a second expandable structure in a collapsed state into the first structure.

30. The method of claim 29 further comprising advancing the second structure through the first structure to a location downhole thereof for deployment.

* * * * *